US006200205B1

(12) United States Patent
Yiu

(10) Patent No.: US 6,200,205 B1
(45) Date of Patent: Mar. 13, 2001

(54) LAPPING TOOL

(76) Inventor: Hing Yiu, Unit 718, Metro Centre II, 21 Lam Hing Street, Kowloon Bay, Kowloon (HK)

( * ) Notice: Subject to any disclaimer, the term of this patent is extended or adjusted under 35 U.S.C. 154(b) by 0 days.

(21) Appl. No.: 09/228,724

(22) Filed: Jan. 12, 1999

(51) Int. Cl.[7] ..... B24B 13/00

(52) U.S. Cl. ..... 451/178; 451/254; 451/60; 451/231; 451/278

(58) Field of Search ..... 451/178, 231, 451/254, 258, 446, 255, 256, 278, 280, 36, 60

(56) References Cited

U.S. PATENT DOCUMENTS 4,908,997 * 3/1990 Field, Jr. et al. ..... 451/256
5,099,617 * 3/1992 Bovine ..... 451/231
5,119,595 * 6/1992 Ushiyama et al. ..... 451/256
5,144,774 * 9/1992 Conboy ..... 451/354
5,149,337 * 9/1992 Watanabe ..... 451/256
5,951,375 * 9/1999 Mandler ..... 451/56
5,951,378 * 9/1999 Mandler ..... 451/231

FOREIGN PATENT DOCUMENTS 35 18 631 2/1986 (DE) .

* cited by examiner

*Primary Examiner*—Eileen P. Morgan
(74) *Attorney, Agent, or Firm*—Jackson Walker L.L.P.

(57) ABSTRACT

A lapping tool has an elongate shank mechanically coupled to a platform, having a generally planar working surface, by a universal joint comprising a ball and socket. A cavity is provided for entrapping grinding paste. Normally, the parts are made of electrically conductive materials so that current can be passed from the shank via the working surface to surface of a workpiece that is to be polished.

11 Claims, 1 Drawing Sheet

LAPPING TOOL

BACKGROUND OF THE INVENTION

1. Field of the Invention

The invention relates to lapping tools.

2. Description of Prior Art

Lapping tools are well-known and used for "polishing" working surfaces by applying an abrasive action using random manual manipulation or machinery constrained (automatic) movements so that the abrasive material smooths and polishes a workpiece surface. The abrasive material may be in the form of a diamond paste and/or the lapping tool itself may be impregnated with a suitable abrasive material. The abrasive material is usually diamond grit but other abrasive materials may be used. Traditionally, the working surface is polished in a number of stages in sequence, using at first relatively course granules or grit and using much finer abrasive particles for the final stages, for example.

It is already known to simultaneously apply ultrasonic signals to cause high frequency vibration to the lapping tool during lapping procedures. Additionally, in some cases, electrical power can also be applied to provide an electrical discharge between the lapping tool and the workpiece surface or, in the presence of a suitable electrolyte, an electrolytic reaction. Such additional techniques, broadly stated, improve the lapping procedures and considerably reduce the time required to carry out the polishing procedures.

A lapping tool is known that is formed of more than one component, where the components are capable of relative pivotable movement. Such a tool is however incapable of making use of the additional techniques.

SUMMARY OF THE INVENTION

It is an object of the invention to overcome this problem.

According to the invention there is provided a lapping tool having an elongate shank and a platform with a generally planar lower operative surface, in which the platform and an end of the shank are connected together by a pivotable joint, and including an electrically conductive path extending from the shank to the lower working surface.

The pivotable joint is preferably a universal joint, and may comprise a ball and socket.

The ball is preferably provided on the end of the shank.

The shank and the platform may be formed of electrically conductive material. The platform may be formed at least in part of plastics material that is impregnated with electrically conductive material to form the said conductive path.

The planar working surface may be impregnated with abrasive material.

The planar working surface may be provided with a cavity exposed at its undersurface, in which abrasive material can be constrained in use.

The ball and socket may be held together by a removable spring clip, or a coiled spring or a screw cap.

BRIEF DESCRIPTION OF THE DRAWINGS

Lapping tools according to the invention will now be described by way of example with reference to the accompanying drawings in which.

DESCRIPTION OF THE PREFERRED EMBODIMENT

Figure 1:
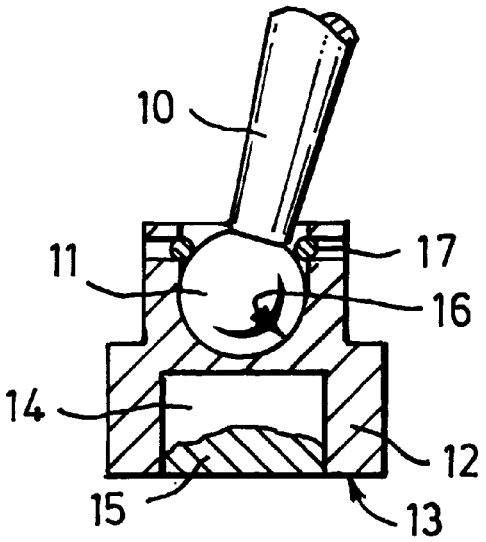
FIG. 1 is a sectional side view of one tool.

Referring to the drawings, in FIG. 1 a lapping tool comprises an elongate shank 10 (only part of which is shown and comprises a cylindrical metallic rod of any suitable length) having an end 11 shaped as a spherical ball. A metallic platform 12 has a lower generally planar working surface 13 formed with a cavity 14 for receiving and holding abrasive/grinding paste 15 in use. As explained above, abrasive paste for polishing is conventionally a "diamond paste" and can be provided in various possible grades and used for coarse and fine polishing as applicable.

The ball 11 is held in and against a spherical socket 16 formed in an upper part of the platform 12 by a circlip 17. An electrically conductive path is therefore formed between the shank 10 and the working surface 13 of the platform 12, to enable electrical current to pass from the shank via the surface 13 to a surface of a workpiece (not shown) immediately below and adjacent the surface 13 in use. Thus, the described lapping tool can be used in conjunction with electrical discharge and electrolytic techniques, known per se. It will be appreciated that the shank may also be exposed to high frequency vibrations caused by ultrasonic or other high frequency signals.

Figure 2:
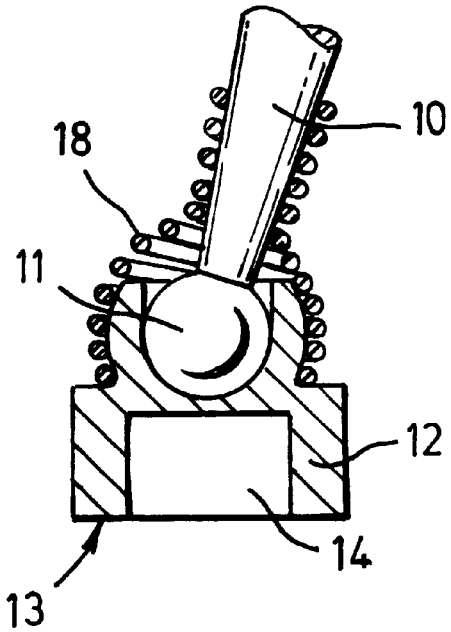
FIG. 2 is a sectional side view of another tool.

In FIG. 2, the lapping tool is generally similar to the lapping tool shown in FIG. 1 except that it is provided with a coiled spring 18 to hold the shank 10 and platform 12 together.

Figure 3:
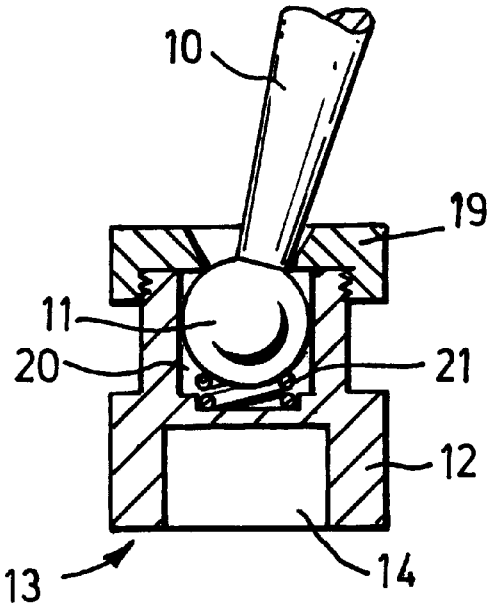
FIG. 3 is a sectional side view of a further tool.

Similarly, in FIG. 3 the shank 10 and the platform are held together by a screwed cap 19. The ball 11 fits into a cylindrical cavity 20 formed in an upper part of the platform 12 and a bias spring 21 is provided in the cavity 19 under the ball 11. Generally, the periphery of the ball 11 will remain in good electrical contact with the inner surface of the cavity 20, but if desired the spring 21 may be formed of electrical conductive material to provide or to ensure a good electrical connection between the ball 11 and the platform 12.

Lapping tools of the invention may comprise several other different arrangements. For example, the universal joint, the ball 11 and socket 16, may be provided in other forms and may also be replaced by a pivotable joint that pivots about a single axis. The pivotable joint is provided to allow the platform 12 to pivot relative to the end of the shank so that its working surface 13 can "float" across the surface of a workpiece in use. This enables the polishing to take place more effectively and efficiently especially if the workpiece surface is not flat or has imperfections that may otherwise disrupt the relatively free polishing movement of the platform over the surface of the workpiece. Where the lapping tool is held in a vice or tool holder, as is the case in an automatic machine, it may sometimes be an advantage or be sufficient to allow the platform to pivot only about a single axis.

It will appreciated that the described universal joint could be formed by a socket formed on the end of the shank 10 for cooperating with a ball provided or formed on an upper part of the platform. The socket or ball provided on the platform may also be positioned, if preferred, on a side of the platform.

Normally, the shank 10 is formed of conductive metallic material. However, it is possible where the shank material is non-conductive, or is a relatively poor conductor of electricity, to have a conductive strip or similar extending along its length to provide an electrically conductive path. The same can apply to the platform 12 where a strip or ring of conductive material can be used as a suitable electrical conductor.

For convenience, easy of manufacture and cost, it may be preferable to form the platform at least partially of plastics material. In that case an electrically conductive plastics material will be required, such as for example as a normal plastic material that is sufficiently impregnated with conductive material so as to provide the necessary electrical path for current to pass from the shank 10 to the working surface 13.

In the described lapping tools grinding paste 15 is used. It is possible alternatively or additionally to form the surface 13, normally with an inherently more wearable material than otherwise, using at least a layer of material impregnated with grinding material, such as industrial diamond grit. This means that the platform 12 will have to be replaced from time to time, or perhaps more often than in the described arrangements. However, as the platform 12 is a separate detachable component of the lapping tool, replacement is not a significant practical difficulty. In such arrangements, the platform 12 is then replaced as required with a new platform or with an unserviceable (i.e. used) platform that has been "re-layered" with a new impregnated working surface layer.

It is noted that the surface 13 has been described as "generally planar". This expression is intended to include a surface that in one plane may however be curved to some extent, as may be required for use in polishing an arcuate surface of a workpiece, such as an outer surface of a shaft to form a polished bearing surface.

I claim:

1. A lapping tool for treating a workpiece surface, the tool having an elongate shank and a platform with a generally planar lower operative surface, in which the platform and an end of the shank are connected together by a pivotable joint, and including an electrical conductor extending from the shank to the lower operative surface to enable an electrical discharge to be applied to the workpiece surface.

2. A lapping tool according to claim 1, in which the pivotable joint is a universal joint.

3. A lapping tool according to claim 2, in which the universal joint is a ball and socket joint.

4. A lapping tool according to claim 3, in which the ball is provided on the end of the shank.

5. A lapping tool according to claim 1, in which the shank and the platform are formed of electrically conductive material to form the electrical conductor.

6. A lapping tool according to claim 5, in which the platform is formed at least in part of plastics material that is impregnated with electrically conductive material to form part of the electrical conductor.

7. A lapping tool according to claim 1, in which the planar working surface is impregnated with abrasive material.

8. A lapping tool according to claim 1, in which the planar working surface is provided with a cavity exposed at its undersurface, in which abrasive material can be constrained in use.

9. A lapping tool according to claim 3, in which the ball and socket are held together by a removable spring clip.

10. A lapping tool according to claim 3, in which the ball and socket are held together by an electrically conductive coiled spring.

11. A lapping tool according to claim 3, in which the ball and socket are held together by a screw cap.

* * * * *